US005623198A

United States Patent [19]

Massie et al.

[11] Patent Number: 5,623,198

[45] Date of Patent: Apr. 22, 1997

[54] APPARATUS AND METHOD FOR PROVIDING A PROGRAMMABLE DC VOLTAGE

[75] Inventors: Harold L. Massie, W. Linn; G. Mark Johnston, Portland, both of Oreg.

[73] Assignee: Intel Corporation, Santa Clara, Calif.

[21] Appl. No.: 576,465

[22] Filed: Dec. 21, 1995

[51] Int. Cl.[6] ..... G05F 1/56

[52] U.S. Cl. ..... 323/282

[58] Field of Search ..... 323/282, 284, 323/285, 286, 287

[56] References Cited

U.S. PATENT DOCUMENTS 3,660,753 5/1972 Judd et al. ..... 323/282
3,809,999 5/1974 Smith ..... 323/282
4,456,872 6/1984 Froeschle ..... 323/286
5,266,884 11/1993 Agiman ..... 323/284
5,481,178 1/1996 Wilcox et al. ..... 323/287

*Primary Examiner*—Matthew V. Nguyen
*Attorney, Agent, or Firm*—Blakely, Sokoloff, Taylor & Zafman

[57] ABSTRACT

A switching regulator circuit comprises a drive circuit, a switching transistor, an output stage and a pre-drive circuit that are coupled in series. The pre-drive circuit is coupled to the drive circuit to apply a pre-drive signal which varies the duty cycle and frequency of a series of drive pulses which activate and deactivate the switching transistor thereby adjusting a voltage of the switching regulator circuit. The pre-drive circuit utilizes a comparator in combination with a hysteresis network to vary the oscillation frequency of the pre-drive signal.

27 Claims, 6 Drawing Sheets

FIG. 3
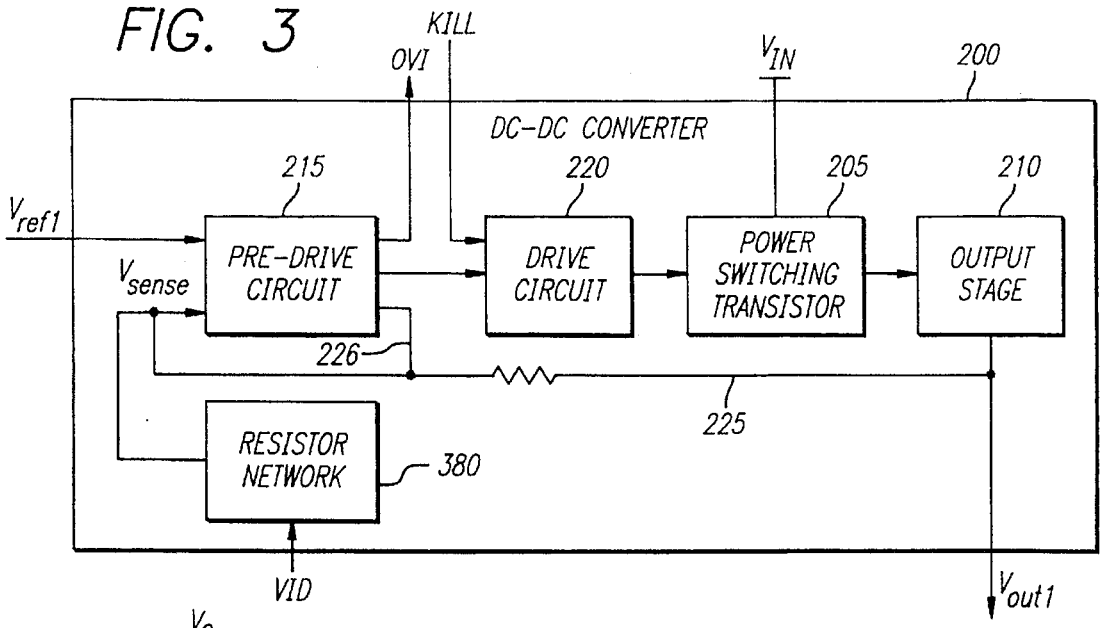
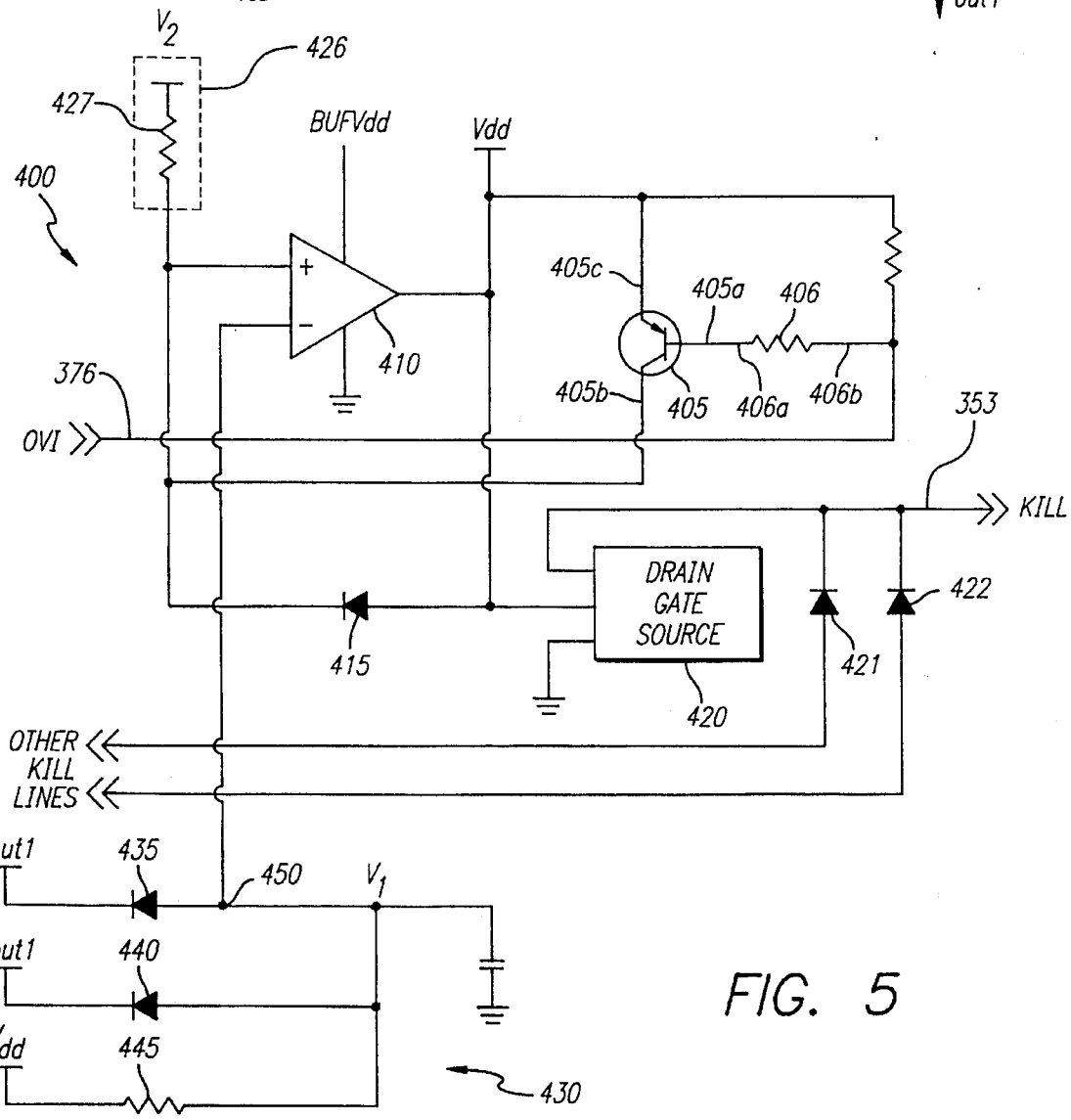
FIG. 5

200
Vdd
347
355
354
356
348
DRIVE CIRCUIT 220
357
353
KILL
349
359
OVI
376
VID
375
383a
382a
366
375b
1 CATHODE 2
3
6
7
8 REF
383b
382b
375a
369
380
382c
371
383m
372
396
370
382m
362
BUFVdd
Vsense
381
360
Vref1
361
390
395
PRE-DRIVE CIRCUIT 215
300

APPARATUS AND METHOD FOR PROVIDING A PROGRAMMABLE DC VOLTAGE

BACKGROUND OF THE INVENTION

1. Field of the Invention

The present invention relates to the field of electronic devices. More particularly, the present invention relates to a switching voltage regulator such as a DC—DC converter.

2. Description of Art Related to the Invention

The power supplies in an electronic system (e.g., computer system, peripheral input/output device, etc.) are designed to meet specific power requirements for components employed within the electronic system. These components usually include integrated circuit chips (ICs) which are manufactured to meet nominal operating voltages recognized by the industry. Typically, nominal operating voltages for ICs are either 3.3, 5 or 12 volts ("V").

In those situations where an IC requires a unique nominal operating voltage, a DC—DC converter may be used to convert a direct current ("DC") input voltage to a desired DC output voltage. DC—DC converters may be broadly classified as linear voltage regulators and switching voltage regulators, and switching voltage regulators may be further classified as pulse-width-modulated ("PWM") converters and resonant converters. Switching voltage regulators are often preferred over linear voltage regulators due to their superior efficiency.

Referring to FIG. 1, a conventional DC—DC converter is shown. The DC—DC converter 10 includes a switching regulator circuit 15, a power switching transistor 20, and an output stage 25 that provides a DC output voltage ("$V_{out}$") to an electronic device such as an IC 30. The DC output voltage "$V_{out}$", provided by the output stage 25, is fed back to the switching regulator circuit 15 via signal line 35. The switching regulator circuit 15 is often a commercially available IC that provides a drive signal for switching the power switching transistor 20 "on" and "off" in response to the sensed value of $V_{out}$. The switching regulator circuit 15 typically includes an internal oscillator circuit that outputs the drive signal at a fixed frequency and an internal reference. The switching regulator circuit 15 modulates the pulse width of the drive signal to vary the amount of time that the power switching transistor 20 is switched on. When switched on, the power switching transistor 20 supplies a DC input voltage ("$V_{in}$") to the output stage 25. Thus, $V_{out}$ is a function of the duty cycle of the drive signal and $V_{in}$. For example, if the switching regulator circuit 15 causes the power switching transistor 20 to be "on" fifty percent of the time, $V_{out}$ supplied to the IC 30 by the output stage 25 is approximately equal to $0.5 \times V_{in}$.

Contrary to conventional converters, another type of switching circuit may be made from low-cost components to perform the switching and regulation functions with the accuracy set by a precision reference. This type of circuit would have superior transient response over the conventional switching converters.

SUMMARY OF THE INVENTION

The present invention relates to a switching regulation circuit comprising an output stage, a switching transistor, a drive circuit and a pre-drive circuit. The pre-drive circuit includes a comparator having a first input through which a hysteresis voltage is applied along with a possibly divided output voltage. The hysteresis voltage is utilized to adjust a duty cycle and frequency of a series of drive pulses from the drive circuit. The series of drive pulses activate and deactivate the switching transistor which, when activated, supplies an input voltage to the output stage and discontinues its supply of the input voltage when the switching transistor is deactivated. As a result, the output stage produces an average DC output voltage having an associated ripple voltage which is restricted within a predetermined voltage margin.

BRIEF DESCRIPTION OF THE DRAWINGS

The features and advantages of the present invention will be apparent from the following detailed description of the invention in which:

FIG. 3 is a schematic diagram of an illustrative embodiment of the improved, programmable DC—DC converter including a power switching transistor, an output stage, a drive circuit and a pre-drive circuit.

FIG. 5 is a schematic diagram of an illustrative embodiment of an over-voltage protection latch circuit disabling one or more DC—DC converters and an over-voltage protection reference circuit providing a reference voltage for the over-voltage protection latch circuit.

DETAILED DESCRIPTION OF THE INVENTION

An apparatus and method for providing an improved, preferably programmable, DC—DC converter for low output voltages is described herein. In order to provide a thorough understanding of the present invention, numerous specific details are set forth such as preferred circuit designs. It will be evident, however, to those skilled in the art that these specific circuit designs illustrate one of a number of embodiments which could be utilized by the present invention. In other instances, well known circuits have not been shown or described in detail in order to avoid unnecessarily obscuring the present invention.

Figure 1:
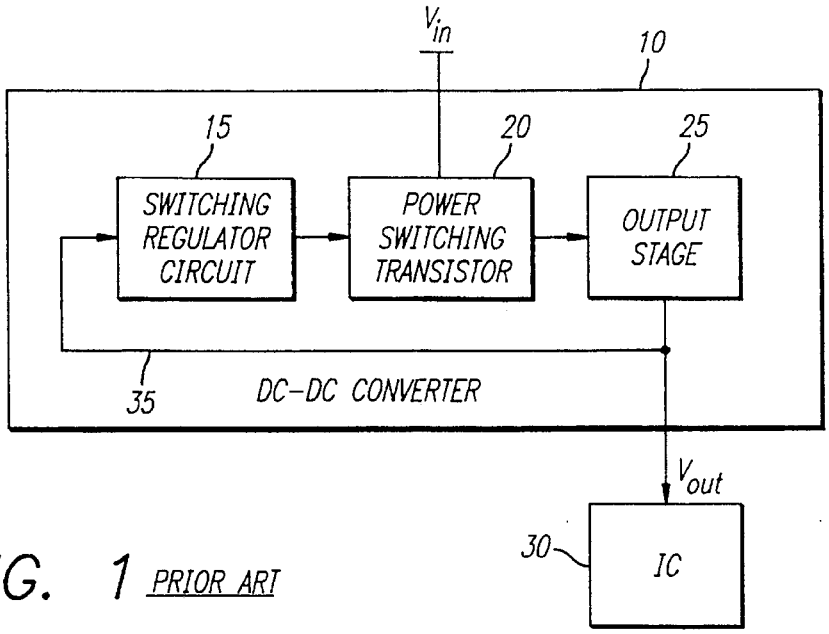
FIG. 1 PRIOR ART
FIG. 1 is a block diagram of a conventional DC—DC converter supplying a DC output voltage "$V_{out}$" to an electronic device.
Figure 2A:
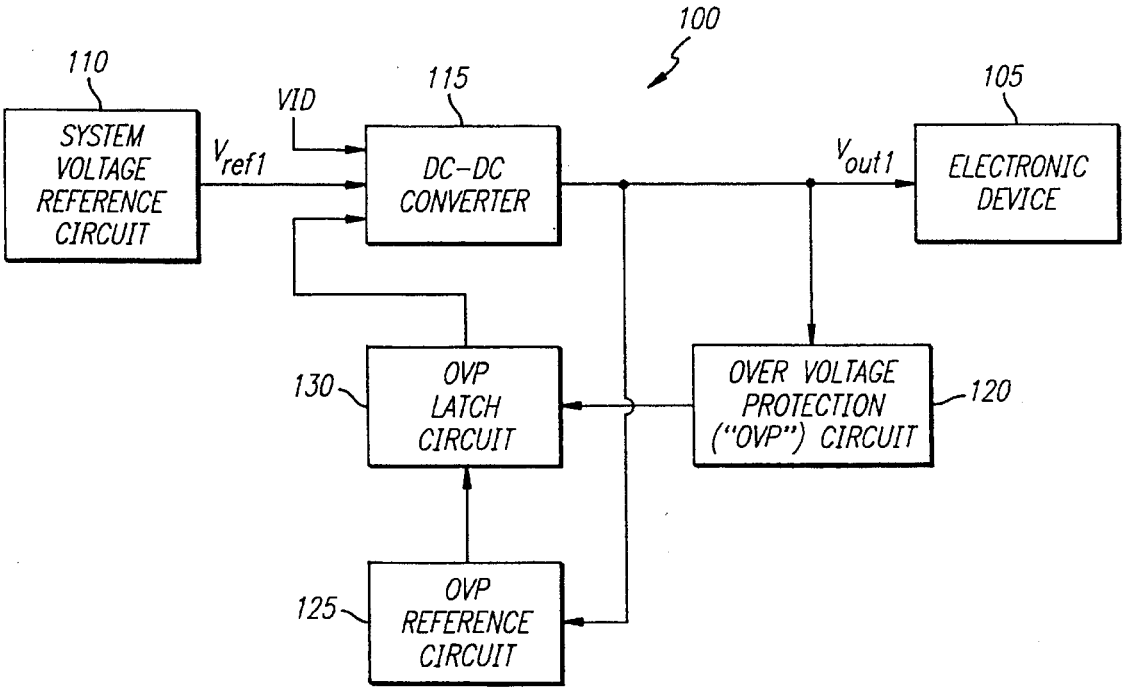
FIG. 2*a* is a block diagram of one embodiment of an electronic system having an improved, programmable DC—DC converter to regulate the voltage supplied to an electronic device.

Referring to FIG. 2*a*, an electronic system 100 supporting an electronic device 105 by converting a reference voltage into an output voltage utilized by the electronic device 105 is illustrated. The electronic system 100 includes a single system voltage reference circuit 110, an improved DC—DC converter 115, an over-voltage protection ("OVP") circuit 120, an OVP reference circuit 125 and an OVP latch circuit 130. The system voltage reference circuit 110 provides a constant reference voltage ("$V_{ref1}$") to the converter 115, which may be any selected voltage (e.g., 2.0 volts). The converter 115 converts $V_{ref1}$ into a first output voltage "$V_{out1}$" which is a nominal operating voltage required by the electronic device 105. This first output voltage may be programmed via multiple voltage identification ("VID") lines by an external source (e.g., a processor).

In addition, $V_{out1}$ is supplied to the OVP circuit 120 and the OVP reference circuit 125. The OVP circuit 120 senses when the voltage provided by the converter 115 exceeds a predetermined threshold for $V_{out1}$ and signals the OVP latch circuit 130 to turn off a power switching transistor employed within the converter 115. This allows the voltage to fall below its predetermined threshold. Similarly, the OVP reference circuit 125 supplies a reference voltage to the OVP circuit 120 to assist in its determination as to whether the voltage provided by the converter 115 exceeds the predetermined threshold of $V_{out1}$.

Figure 2B:
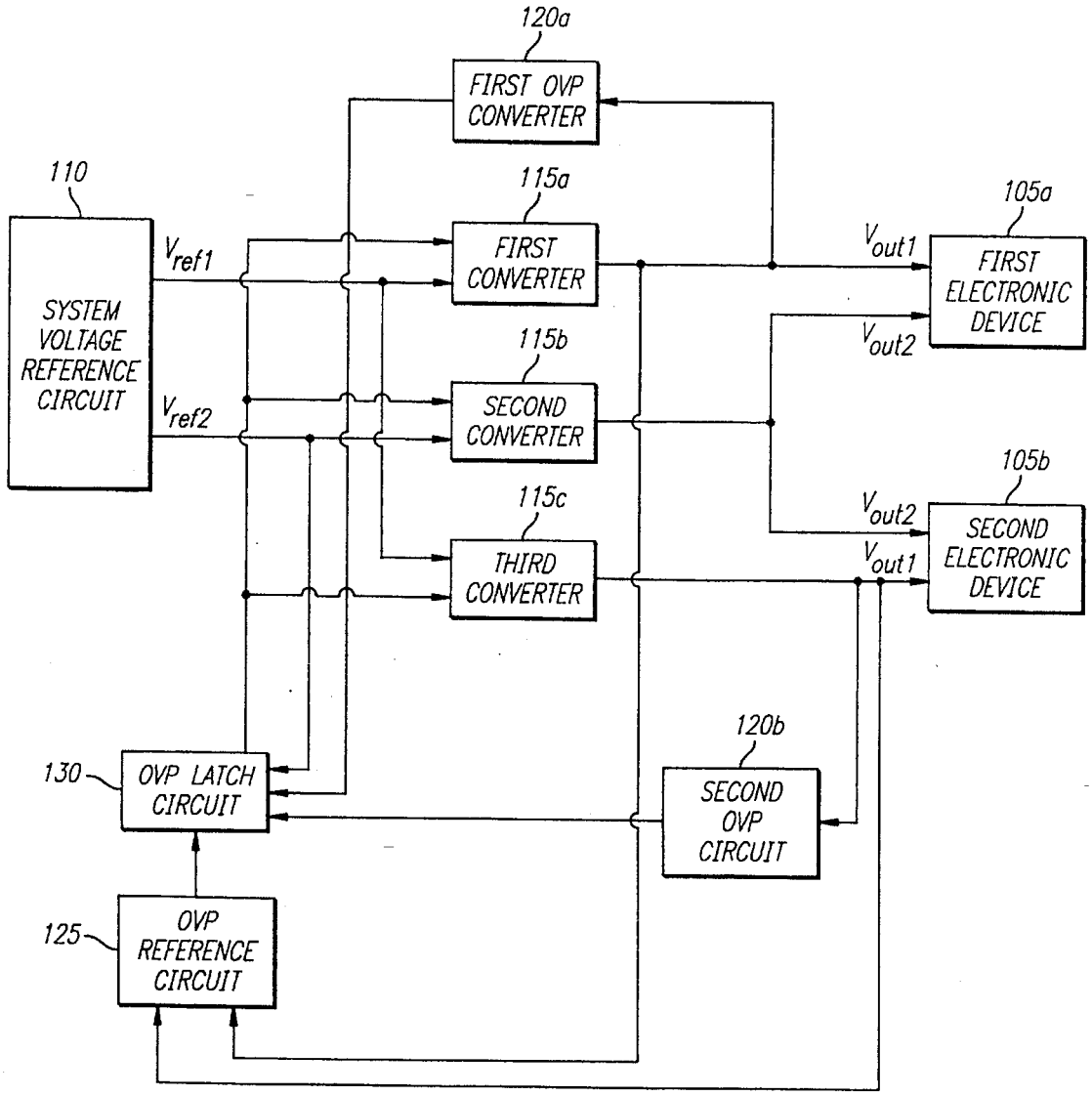
FIG. 2*b* is a block diagram of another embodiment of the electronic system utilizing two programmable DC—DC converters supplying $V_{out1}$ and a non-programmable DC—DC converter supplying $V_{out2}$ to support multiple electronic devices.

Referring to FIG. 2*b*, it is contemplated that the electronic system could be configured to provide a number of nominal operating voltages $V_{out1}$ and $V_{out2}$ to multiple electronic devices. This configuration would be similar to the embodiment of FIG. 2*a* except the system voltage reference circuit 110 provides two reference voltages, $V_{ref1}$ to the first and third converters 115*a* and 115*c* (e.g., programmable DC—DC converters) and $V_{ref2}$ to a second converter 115*b* (e.g., non-programmable DC—DC converter). While the first and third converters 115*a* and 115*c* require different OVP circuits 120*a* and 120*b* and the second converter 115*b* may include an OVP circuit, all converters would share the same voltage reference circuit 110, OVP reference circuit 125 and OVP latch circuit 130.

Referring now to FIG. 3, a block diagram of the improved DC—DC converter incorporating the OVP circuit of FIG. 2*a* is shown. The DC—DC converter 200 includes a power switching transistor 205, an output stage 210, a pre-drive circuit 215, and a drive circuit 220. The power switching transistor 205 is switched on and off, coupling and decoupling the DC input voltage to the output stage 210, in response to a series of drive pulses provided by the drive circuit 220. The output stage 210 averages the input pulses to output the DC output voltage "$V_{out1}$" having an oscillating ripple voltage. The pre-drive circuit 215 provides a pre-drive signal to the input of the drive circuit 220 to vary the duration and frequency of the drive pulses produced by the drive circuit 220.

A regenerative feedback connection 226 is coupled between the input and the output of the pre-drive circuit 215 to provide hysteresis such that the pre-drive circuit 215 oscillates, periodically pulsing the pre-drive signal, which, in turn, results in the ripple voltage at the output of the output stage 210. The ripple voltage causes the sensed value of $V_{out1}$ to change, the hysteresis voltage provided by the feedback connection 226 causes the pre-drive circuit 215 to continue to oscillate. A feedback loop 225 from the output stage 210 to the pre-drive circuit 215 may be used to vary both the frequency and the pulse width of the drive pulses so that an appropriate output voltage $V_{out1}$ is output by the DC—DC converter 200.

Figure 4A:
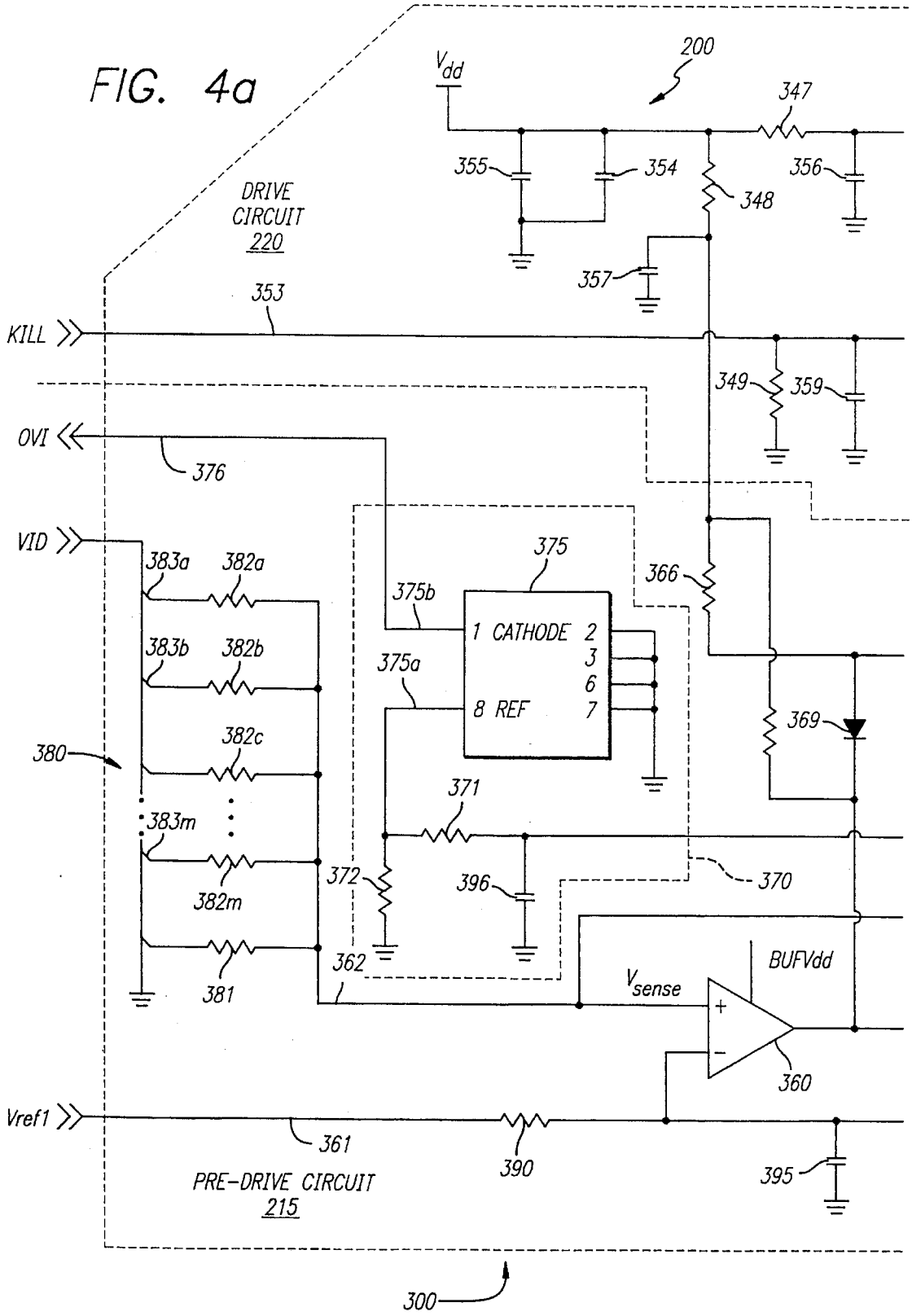
FIGS. 4*a*, 4*b* are schematic diagrams of the improved programmable DC—DC converter of FIG. 3 further including an over-voltage protection circuit.

As will be discussed below, the pre-drive circuit 215 includes a comparator (as shown in FIG. 4*a*) that compares a sensed voltage ("$V_{sense}$") to the highly accurate reference voltage $V_{ref1}$. $V_{sense}$ represents the combination of an average DC operating voltage supplied to the positive input of the comparator and a hysteresis voltage "$V_{hyst}$" provided by a hysteresis network in response to the pre-drive signal. The output of the comparator oscillates in response to the comparison between $V_{sense}$ and $V_{ref1}$. In this embodiment, the DC—DC converter 200 may further be programmable through voltage identification "VID" lines to allow $V_{sense}$ to be modified as needed.

For this embodiment, the pre-drive circuit 215 draws current bearing a linear relationship to $V_{hyst}$. As a result, $V_{hyst}$ forces the output of the pre-drive circuit 215 to vary the duty cycle and frequency of the pre-drive signal to maintain constant output ripple voltage amplitude as well as average DC voltage. This variation influences the duration and frequency of the drive pulses provided to the power switching transistor 205 by the drive circuit 220 which, in turn, varies $V_{out1}$.

Figure 4B:
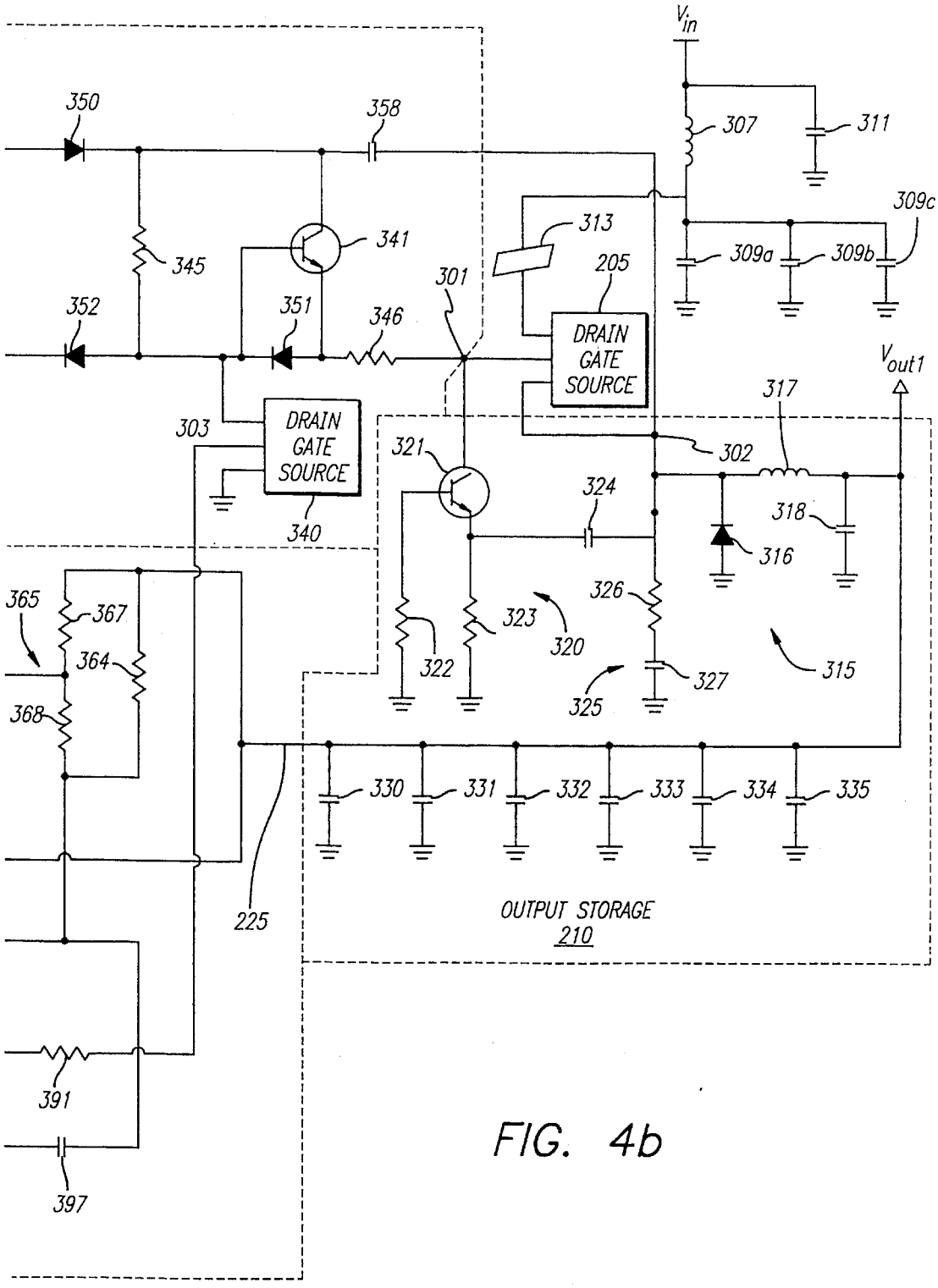

Referring to FIGS. 4*a* and 4*b*, a schematic diagram of the improved DC—DC converter including the pre-drive circuit of FIG. 3 is shown. The improved DC—DC converter 200 includes a power switching transistor 205, which is shown as an enhancement mode field effect transistor ("FET") having a drain, a gate, and a source. The power switching transistor 205 alternatively may be a bipolar junction transistor ("BJT"), or any other appropriate device. The gate of the power switching transistor 205 is coupled to the drive circuit 220 at node 301 to receive drive pulses. Moreover, the drain of the power switching transistor 205 is coupled to receive the DC input voltage ("$V_{in}$") while its source is coupled to the output stage 210 at node 302.

The path from the DC input voltage "$V_{in}$", which may be, for example, 5.0 volts ("$V_{cc}$") or 12.0 volts ("$V_{dd}$"), includes an inductor 307, capacitors 309*a*–309*c* and 311, and a ferrite bead 313. The inductor 307 is provided to isolate the DC input voltage supply from the current pulses that result from power switching transistor 205 being turned on and off. Capacitors 309*a*–309*c* are used to store energy that is supplied to the source of power switching transistor 205 when it is switched on while capacitor 311 acts as a high frequency bypass capacitor. The ferrite bead 313 prevents the drive circuit 220, power switching transistor 205, and output stage 210 from oscillating during switching transitions by the power switching transistor 205. When $V_{in}$ is equal to $V_{dd}$, the inductive value of the inductor 307 may be selected to be approximately 3.8 μH, while the capacitive value of capacitors 309*a*–309*c* and 311 may be 0.1 μF, 1500 μF, 1500 μF and 0.1 μF, respectively. The resistive value of ferrite bead 313 may be 0.90 Ω at 100 MHz. The values of the inductor 307, the capacitors 309*a*–309*c* and 311 and the ferrite bead 313 may be adjusted to provide optimized performance for different values of $V_{in}$.

The output stage 210 of the DC—DC converter 300 generally comprises (i) a load and filter circuit 315 including a catch diode 316, an inductor 317 and a capacitor 318; (ii) a quick shut-off circuit 320 including a NPN transistor 321, resistors 322 and 323, and capacitor 324; and (iii) a RC snubber circuit 325 including a resistor 326 coupled in series with a capacitor 327, both of which are coupled between the source of power switching transistor 205 and ground for filtering high frequency noise at the source of power switching transistor 205 during switching transitions. The output stage 210 further includes bypass capacitors 330–335 coupled between the output of the DC—DC converter and ground via the feedback connection 225 in order to filter load transients. For this example, the parallel capacitance of capacitors 330–335 may be set to be 9000 μF but may be set at approximately 1000 μF, provided the internal resistance of the bypass capacitors is low enough to maintain sufficient voltage margins during current load steps. Of course, the capacitance of bypass capacitors 330–335 may be varied or provided through the use of a single capacitor having an appropriate capacitance.

When the power switching transistor 205 is switched on (i.e., activated), the DC input voltage at the drain of power switching transistor 205 is conducted to the source of power switching transistor 205, which is coupled to the catch diode 316 and the inductor 317 of the load and filter circuit 315. When the power switching transistor 205 is switched on, the catch diode 316 is back-biased, and current flows through the inductor 317, which stores energy and provides the output load current to any electronic devices ("load") coupled to the output stage 210. When the power switching transistor 205 is switched off (i.e., deactivated), the inductor 317 releases the stored energy, causing the catch diode 316 to go into conduction, and a load current continues to flow through the inductor 317. The inductor 317 and the capacitor 318 filter the voltage pulses of the power switching transistor 205 into an average DC output voltage $V_{out1}$ having an associated output ripple voltage. If the desired DC output voltage $V_{out1}$ is 2.9 volts and $V_{in}$ is 12.0 volts, the chosen values of the inductor 317, capacitor 318 and bypass capacitors 330–335 may be 7.8 μH, 0.1 μF and as low as 600 μF, respectively. Almost any DC input voltage "$V_{in}$" may be used to produce a desired DC output voltage "$V_{out1}$" so long as $V_{in}$ is greater than $V_{out1}$.

The purpose of the catch diode 316 is to prevent a voltage level that is greater than one diode drop below ground from being presented at the source of power switching transistor 205. Typically, catch diode 316 is unable to go into conduction instantaneously, and a significant negative voltage may be produced at the source of power switching transistor 205 when the power switching transistor 205 is initially turned off. A significant negative voltage on the source of power switching transistor 205 can result in the power switching transistor 205 conducting current when the drive pulse is removed, at which time the gate voltage of transistor 205 is discharged towards ground, and the power switching transistor 205 is ostensibly switched off. Significant switching losses can result. The output stage 210 of the DC—DC converter 200 therefore includes the quick shut-off circuit 320 that applies a negative voltage to the gate of power switching transistor 205 when the power switching transistor 205 is switched off.

The quick shut-off circuit 320 is a common-base amplifier circuit wherein the emitter of transistor 321 is coupled to the source of power switching transistor 205 through the capacitor 324, and the collector of transistor 321 is coupled to the gate of power switching transistor 205. When the drive pulse is removed from the gate of power switching transistor 205 to switch off power switching transistor 205, the voltages at both the gate and the source of power switching transistor 205 fall towards ground. The negative voltage on the source of power switching transistor 205 causes the capacitor 324 to produce a negative voltage at the emitter of transistor 321. This negative voltage causes transistor 321 to saturate and appear on the collector of transistor 321, which is coupled to the gate of power switching transistor 205. The negative voltage forces the gate of the power switching transistor 205 below ground, reducing the positive difference in potential between the gate and the source of power switching transistor 205 such that the gate-source voltage of power switching transistor 205 is less than the threshold voltage for the power switching transistor 205. For the present embodiment, the negative gate voltage is applied for approximately 200 nanoseconds. The NPN transistor 321 may be a 2N4401 manufactured by Motorola, Inc. of Schaumburg, Ill., the value of resistor 322 may be 1 kΩ, the value of resistor 323 may be 100 Ω, and the value of capacitor 324 may be 0.01 μF.

The drive circuit 220 of DC—DC converter 300 includes transistors 340 and 341, resistors 345–349 diodes 350–352 and capacitors 354–359. Of these components, transistor 341 in combination with diode 350, resistors 345–346 and capacitor 358 form a bootstrap circuit which provides a high current drive signal at the gate of the power switching transistor 205 when transistor 340 is switched off. Preferably, transistor 341 may be a NPN transistor similar to transistor 321, the value of resistors 345 and 346 may be 1 kΩ and 24 Ω, respectively, and the value of capacitor 358 may be 0.1 μF.

The pre-drive signal is provided to the gate of transistor 340, preferably a field effect transistor, at node 303 in order to switch transistor 340 on and off. More specifically, when transistor 340 is switched off, the transistor 341 provides the high current drive signal, approximately equal to $V_{dd}+V_{in}$, to the gate of power switching transistor 205. This quickly switches the power switching transistor 205 on. When the pre-drive signal is sufficiently high, transistor 340 is switched on, which provides a path from the gate of power switching transistor 205, through diode 351, to ground. Thus, diode 351 provides a high gate sink current such that the gate of power switching transistor 205 is discharged quickly towards ground, and power switching transistor 205 is switched off quickly to reduce switching losses.

Resistor 347 and capacitor 356 are provided as a filter circuit for filtering noise from a DC input voltage line. Such noise may be injected by the operation of diode 350. The value of resistor 347 may be 10 Ω, while the value of capacitor 356 may be 1.0 μF. Resistor 348 and capacitor 357 also filter noise from the DC input voltage line where it is coupled to the pre-drive circuit 215, where the values of resistor 348 and capacitor 357 may be equivalent to the values of resistor 347 and capacitor 356, respectively.

The diode 352 performs two functions. A first function is that the diode 352 shuts off the power supply if the OVP circuit for the DC—DC converter experiences an overvoltage condition and sinks current along a power-kill ("KILL") line 353. A second function is that it prevents the power switching transistor 205 from being turned on too quickly by limiting the rise time of the drain voltage of the transistor 340 as capacitor 359 is charged through resistor 349. Resistor 349 provides a discharging path for capacitor 359.

Referring still to FIGS. **4*a* and 4*b*, the pre-drive circuit 215 supplies the pre-drive signal to node 303 for switching transistor 340 on or off. The pre-drive circuit 215 includes a comparator 360; a hysteresis network 365; and a resistor network 380 including a fixed resistor 381 and "m" programmable 382*a*–382*m* ("m" being an arbitrary whole number). The pre-drive circuit 215 further includes various resistors 390–391 and capacitors 395–397 employed for filtering such as a common mode capacitor 397, coupled between the positive and negative inputs of the comparator 360, which assists in stabilizing the frequency of the comparator 360 and reduces noise on these inputs. These components are coupled in such a fashion that the frequency of the pre-drive signal produced by the comparator 360** will increase as $V_{out1}$ is increased. As a consequence, a higher $V_{out1}$ increases the hysteresis voltage thereby decreasing its frequency.

The comparator 360 includes a negative input coupled to a reference line 361 and a positive input. The reference line 361 applies a reference voltage "$V_{ref1}$" (e.g., 2 V) to the negative input of the comparator 360. A resistor 390 and capacitor 395 are coupled to the reference line 361 to filter any noise that could appear at the negative input of the comparator 360. With respect to the positive input of the comparator 360, the sensed output voltage is applied to the positive input after being fed back from the output stage 210 of the DC—DC converter and divided down through a high accuracy resistor 364 (e.g. 0.1% tolerance) and the resistor network 380.

As shown, the resistor network 380 provides a low-cost technique of programming the nominal output voltage of the DC—DC converter to reside within a range of voltages. The resistor network 380 includes a fixed resistor 381 and "m" programmable resistors 382*a*–382*m* (where "m" is an arbitrary whole number greater than one) configured in parallel with the fixed resistor 381. A plurality of voltage identification ("VID") lines 383*a*–383*m*, each VID line dedicated to a different programmable resistor 382*a*–382*m*, are coupled to a first lead of the programmable resistors 382*a*–382*m*. The VID lines propagate a binary code in which its bit representation determines which first leads of the programmable resistors are left open or shorted to ground. As a result, an external source (e.g., a CPU) is able to program the average operating voltage over a range of voltages by selectively grounding none, one or more first lead of the programmable resistors 382*a*–382*m*. For example, the external source can program the resistor network to provide $V_{out1}$ ranging from 2 V–3.5 V when the fixed resistor 381 has a resistance of approximately 2.2 kΩ and the programmable resistors 382*a*–382*m*, namely four programmable resistors 382*a*–382*c* and 382*m* have resistances of approximately 20 kΩ, 10 kΩ, 5 kΩ and 2.5 kΩ, respectively.

The hysteresis network 365 includes the resistor 364, bias resistors 366 and 367, a hysteresis resistor 368 and a diode 369 which collectively operate to maintain the switching frequency of the DC—DC converter at a fairly constant rate by making the hysteresis voltage as a function of the output voltage. This is done to maintain converter efficiency because converter frequency affects the losses in the switching transistor 305 and the inductor 317. The hysteresis network 365 is coupled between the output of the comparator 360 and its positive input allowing it to set the switching frequency of the comparator 360 by applying a hysteresis voltage ("$V_{hyst}$") to the positive input. The combination of the hysteresis voltage, inductor 317 and the bypass capacitors 330–335 sets the frequency. Thus, the output voltage "$V_{out1}$" as programmed through the VID lines 383*a*–383*m* provides the majority effect on the hysteresis network 365 while the output ripple voltage does provide unwanted change to $V_{hyst}$ but its effect is minimal.

As further shown in FIGS. 4*a* and 4*b*, as $V_{out1}$ varies, the voltage at the anode of the diode 369 varies. As a result, the voltage across the hysteresis resistor 368 i.e., "$V_{hyst}$" changes in proportion to the variation of $V_{out1}$ causing more voltage to be supplied to the positive input of the comparator 360 than $V_{sense}$. Thus, until $V_{out1}$ decays by a voltage equal to $V_{hyst}$ set by the hysteresis resistor 368, the comparator 360 will continue to transmit a "high" signal to the transistor 340 which keeps the power switching transistor 205 turned "off". When the output voltage falls enough for $V_{sense}$ (i.e., the voltage at the positive input of the comparator 360) to be less than the voltage at the negative input, the comparator 360 switches the output "low" thereby turning on the power switching transistor 205 and turning "off" the transistor 340. Resistor 368 provides negative hysteresis so that $V_{out}$ will have to increase until $V_{sense}$ exceeds the voltage applied to the negative input in order to repeat the cycle.

The use of the comparator 360 in this circuit allows a slow switching frequency (100 KHz) so that low-cost, low-loss transistors and inductors may be used. Yet, the DC—DC converter 300 achieves a very good response speed like a 500 KHz converter would possess. The converter disclosed herein can respond to a load transient of at least 700 nanoseconds ("ns") which is equivalent to at least a 1 MHz converter.

The programmable converter may further include an over-voltage protection ("OVP") circuit 370 which is used to permanently turns off the power switching transistor 205 when the output voltage is greater than a predetermined threshold voltage. It is contemplated that the OVP circuit 370 may be external to the converter 300. The OVP circuit 370 includes a voltage divider formed by resistors 371 and 372 in order to reduce the voltage provided to the voltage reference IC 375 (e.g. TL 431). A reference input pin (pin 8) of the voltage reference IC 355 receives the sense voltage $V_{sense}$ that depends on $V_{out1}$. If the reference input pin 375*a* receives a voltage that is greater than the internal reference voltage of the voltage reference IC 375, current flows into a cathode pin 375*b* of the voltage reference IC 375 and propagates through a over-voltage indication ("OVI") line 376 coupled to the OVP latch circuit 400 as shown in FIG. 2*a* and 5. Otherwise, little or no current flows into the cathode pin 375*b*.

Referring now to FIG. 5, a schematic diagram of an illustration embodiment of the OVP latch circuit 400 is shown wherein the OVP latch circuit 400 is external to the converter as shown in FIG. 2*a* and is implemented with the non-programmable converter of FIG. 2*b*. It is contemplated, however, that the OVP latch circuit may be implemented within the DC—DC converter of FIG. 4 or employed external to the DC—DC converter in any type of device. The OVP latch circuit 400 comprises a PNP transistor 405 having its base 405*a* coupled to a first lead 406*a* of a resistor 406 having its second lead 406*b* coupled to the OVI line 376 and comparator 410. If an over-voltage condition occurs on the OVP line, the OVP voltage on the OVI line 376 drops to 2 V from the $V_{dd}$ line thereby pulling current through an emitter-base junction of the PNP transistor 405 through resistor 406. This turns on the PNP transistor 405 causing a collector 405*b* of the PNP transmitter to saturate to its emitter 405*c* so that the collector 405*b* is raised to a voltage "$V_{dd}$". Thus, $V_{dd}$ is supplied to the positive input of a comparator 410 of the OVP latch circuit 400. This causes the comparator 410 to output a logic "high" signal.

Since an anode of a diode 415 is coupled to the output of the comparator 410 and its cathode is coupled to the positive input of the comparator 410, the diode 415 latches the comparator 410 causing it to continue outputting a logic "high" signal until power is removed from the converter 200. Besides placing the OVP latch circuit 400 is a "latch" mode, the logic "high" output from the comparator 410 turns on a FET 420 causing the drain of the FET 420 to sink current. This prevents the converter from operating because the power switching transistor can never be turned on because it would require the cathode of the diode 352 on line 353 to have a voltage placed thereon. Because the cathode of the diode will continue to remain low since current is being sunk into the transistor, the power switching circuit can never go high. In accordance with the electronic system of FIG. 2*b*, two diodes 421 and 422 are coupled to the power-kill ("KILL") line to concurrently halt operations by more than one converter. For example, it is contemplated that an OVP circuit 425 may be implemented within the second converter 115*b* of FIG. 2*b* which includes a power supply 426 and a resistor 427 coupled to the positive input of the comparator 410.

The negative input of the comparator is coupled an OVP Reference circuit 430 comprising a pair of diodes 435 and 440 oriented in parallel to share a common anode. The cathode of each diode 435 and 440 receives the DC output voltage of its corresponding converter. In this case, the first converter of FIG. 2*a* provides "$V_{out1}$". Also, for FIG. 2*b*, the first and third converters supply "$V_{out1}$". The voltage supplied to the common anode is equal to $V_1$ which is the voltage realized after voltage divided by resistor 445. Thus, $V_1$ is equal to one diode voltage drop higher than the lowest DC output voltage applied to the diodes 435 or 440. Since the comparator 410 is latched if the voltage supplied to the positive input of the comparator is higher than voltage applied to node 450.

This reference voltage applied to node 450, and thus the negative input of comparator 410, will stay equal to the lowest voltage $V_{out1}$ plus one diode drop even though the other one is running away. This means that $V_{out2}$ voltage can never exceed the $V_{out1}$ voltage by more than one diode drop compliant with many processor specifications.

Figure 6:
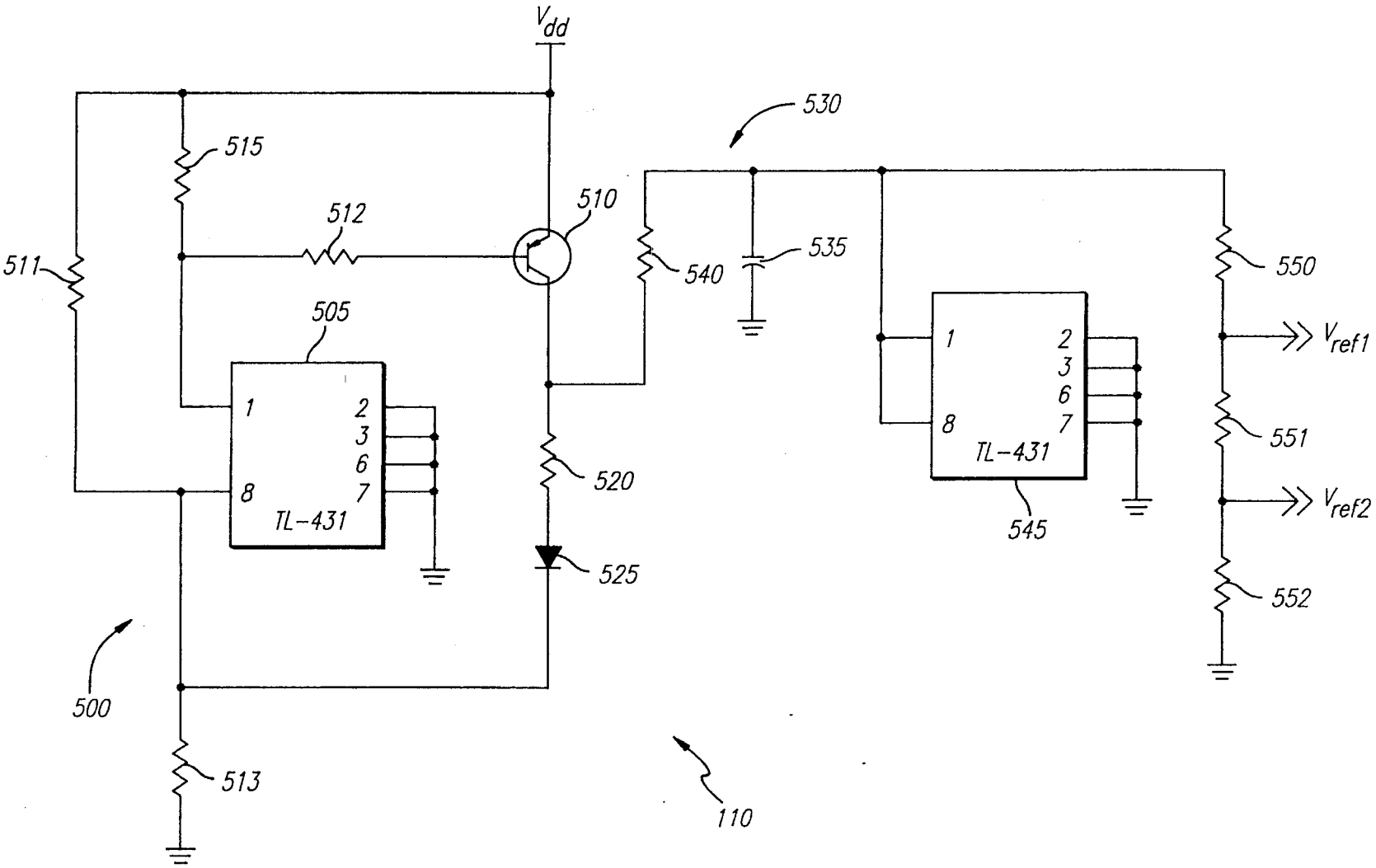
FIG. 6 is a schematic diagram of an illustrative embodiment of a system voltage reference circuit outputting a reference voltage to the improved, programmable DC—DC converter of FIGS. 4*a*, 4*b*.

Referring to FIG. 6, the system voltage reference circuit 110 includes an under-voltage lockout circuit 500 and a slow-start circuit 530. The under-voltage lockout circuit 500 includes a voltage reference IC 505 (e.g., TL 431) having an internal reference voltage (preferably 2.5 V). A resistor 511 is coupled between a power supply supplying a common operating voltage "$V_{dd}$" to a reference input pin (pin 8) of the voltage reference IC 505. The voltage reference IC 505 further has a cathode input pin (pin 1) coupled to a resistor 515 and a resistor 512 and coupled to a base of a transistor 510. Both the resistor 515 and the emitter of the transistor 510 are coupled to the power supply.

When the reference input pin of the voltage reference IC 505 has a higher voltage than the internal reference voltage, current is sunk into the cathode pin (pin 1). In this embodiment, if the resistor 511 is approximately 3 k Ω, the voltage reference IC 505 is set to sink current when $V_{dd}$ rises greater than 10 volts. Thus, whenever $V_{dd}$ is greater than 10 volts, the voltage on the reference input pin will be greater than the internal reference voltage causing current to be sunk into its cathode input pin. When current is sunk into the cathode input pin, it also sinks current into the transistor 510, between the base emitter junction through resistor 512, which turns on the transistor 510. By turning on the transistor 510, the voltage at the collector will be approximately $V_{dd}$ which is applied to the reference input pin via resistor 520 and diode 525. As a result, the voltage on the reference input pin will be higher than the internal reference voltage all the time so that the transistor 510 is latched "on" unless the voltage $V_{dd}$ drops down below a predetermined percentage of $V_{dd}$ (e.g., around 9 V) before the voltage on the reference input pin falls below the internal reference voltage. When transistor 510 turns "off", then $V_{dd}$ must go back up to 10 volts again and have the same circuit operation.

With respect to the slow-start circuit 530, once the transistor 510 turns "on", current flows through the resistor 540 allowing capacitor 535 to charge. This allows one or more reference voltages (e.g., $V_{ref1}$ and $V_{ref2}$ Of FIG. 2*b*) to ramp up together because the voltage uniformly increases for both reference voltages. A voltage reference IC 545 regulates the capacitor 535 to preclude it from having a voltage larger than 2.5 V where $V_{ref1}$ and $V_{ref2}$ if two reference voltages are needed (see FIG. 2*b*) are approximately 2 V and 1.5 V, resistors 511–513, 515, 520, 540 and 550–552 are approximately equal to 3 KΩ, 1 KΩ, 1 KΩ, 1 KΩ, 10 KΩ, 500 Ω, 100 Ω, 100 Ω and 301 Ω respectively and capacitor 535 is approximately equal to 22 μF. Thus, once the voltage of the capacitor 540 ramps up to 2.5 volts, then $V_{ref1}$ is equal to 2 V and $V_{ref2}$ is equal to 1.5 V because the IC 545 regulates the voltage at its cathode (pin 1) to 2.5 V by controlling the current through resistor 540.

In the foregoing specification the invention has been described with reference to specific exemplary embodiments. It will, however, be evident that various modifications and changes may be made thereto without departing from the broader spirit and scope of the invention as set forth in the appended claims. The specification and drawings should be construed in an illustrative rather than restrictive sense.

What is claimed is:

1. A switching regulator circuit comprising:

an output stage that produces an output voltage having an oscillating ripple voltage along a feedback line;

a switching transistor coupled to said output stage, said switching transistor supplies an input voltage to said output stage when said switching transistor is activated;

a drive circuit coupled to said switching transistor, said drive circuit regulates said output voltage by generating a series of drive pulses to activate and alternatively deactivate said switching transistor; and a pre-drive circuit coupled to said drive circuit and said feedback line, said pre-drive circuit including a comparator which utilizes a hysteresis voltage applied to a first input of said comparator in order to adjust a duty cycle and frequency of said series of drive pulses to regulate said output voltage.

2. The switching regulator circuit according to claim 1, wherein said pre-drive circuit further includes a hysteresis network coupled to the feedback line and said first input of said comparator and an output of said comparator.

3. The switching regulator circuit according to claim 2, wherein said comparator of said pre-drive circuit outputs an oscillatory pre-drive signal to said drive circuit which sets the duty cycle and frequency of said series of drive pulses, said comparator compares a sense voltage, which is based on said output voltage and said hysteresis voltage and applied to said first input of said comparator, to a reference voltage applied to a second input of said comparator.

4. The switching regulator circuit according to claim 3, wherein the pre-drive circuit further comprises a resistor network coupled to said first input of said comparator, said resistor network is programmable to adjust said sense voltage in order to produce said output voltage ranging from a minimum threshold voltage to a maximum threshold voltage.

5. The switching regulator circuit according to claim 4, wherein said resistor network includes a fixed resistor and a plurality of programmable resistors configured in parallel with said fixed resistor, said resistor network receives a binary voltage identification to select one or more of said plurality of programmable resistors in order to alter said output voltage as desired.

6. The switching regulator circuit according to claim 2 further including an over-voltage protection circuit coupled to said feedback line, said over-voltage protection circuit detects when said output voltage exceeds a maximum threshold voltage and transmits a control signal to deactivate said switching transistor.

7. The switching regulator circuit according to claim 6, wherein said over-voltage protection circuit permanently deactivates said switching transistor until reset.

8. The switching regulator circuit according to claim 1, wherein said switching transistor includes a first electrode which receives said input voltage, a second electrode and a control electrode, said control electrode is used to couple and decouple the first electrode and the second electrode in response to said series of drive pulses.

9. The switching regulator circuit according to claim 8, wherein said output stage includes an input coupled to the second electrode of the switching transistor and an output that outputs said output voltage in response the input voltage being coupled and decoupled from the second electrode of the switching transistor.

10. The switching regulator circuit according to claim 8, wherein said drive circuit includes a transistor including a source coupled to ground, a gate coupled to said pre-drive circuit to receive an oscillatory pre-drive signal and a drain coupled to the control electrode of the switching transistor, said drive circuit providing said series of drive signals to said control electrode of said switching transistor in response to said oscillatory pre-drive signal.

11. The switching regulator circuit according to claim 10, wherein said pre-drive circuit includes the comparator having a first input, a second input and an output coupled to said gate of said transistor, said comparator comparing a sense voltage, which is based on said output voltage and said hysteresis voltage and applied to said first input, to a reference voltage applied to said second input of said comparator, said comparator produces said pre-drive signal to said drive circuit in response to a comparison between said reference voltage and said sense voltage.

12. The switching regulator circuit according to claim 11, wherein said pre-drive circuit includes a hysteresis network which supplies said hysteresis voltage of said first input.

13. A switching regulator circuit comprising:

output means for producing an output voltage having an oscillating ripple voltage along a feedback line;

switching means for supplying an input voltage to said output stage when said switching means is activated, said switching means being coupled to said output means;

drive means for regulating said output voltage by generating a series of drive pulses to activate and alternatively deactivate said switching transistor, said drive means being coupled to said switching means; and pre-drive means for using a hysteresis voltage applied to an input of said pre-drive means in order to adjust a duty cycle and frequency of a pre-drive signal which causes said drive means to generate said series of drive pulses, said pre-drive means, being coupled to said drive circuit and said feedback line, includes a comparator means for outputting said pre-drive signal in response to a comparison between a reference voltage and a sense voltage including said hysteresis voltage.

14. The switching regulator circuit according to claim 13, wherein said pre-drive means further includes a hysteresis network being coupled to a first input of said comparator means and an output of said comparator means.

15. The switching regulator circuit according to claim 14, wherein the pre-drive means further comprises a resistor network coupled to said first input of said comparator means, said resistor network is programmable to adjust said sense voltage in order to produce said output voltage ranging from a first threshold voltage to a second threshold voltage.

16. The switching regulator circuit according to claim 15, wherein said resistor network includes a fixed resistor and a plurality of programmable resistors configured in parallel with said fixed resistor, said resistor network receives a binary voltage identification to select one or more of said plurality of programmable resistors in order to alter said output voltage as desired.

17. The switching regulator circuit of claim 13 further including over-voltage protection means for detecting when said output voltage exceeds said second threshold voltage and for transmitting a control signal in order to deactivate said switching means, said over-voltage protection means being coupled to said feedback line.

18. An electronic system comprising:

a voltage reference circuit;

a converter coupled to said voltage reference circuit, said converter including an output stage producing an output voltage ranging between a first threshold voltage and a second threshold voltage along a feedback line, a switching transistor coupled to said output stage, said switching transistor supplies an input voltage to said output stage when said switching transistor is activated, a drive circuit coupled to said switching transistor, said drive circuit regulates said output voltage by generating a series of drive pulses to activate and alternatively deactivate said switching transistor, and a pre-drive circuit coupled to said drive circuit and said feedback line, said pre-drive circuit including a comparator which utilizes a hysteresis voltage applied to a first input of said comparator in order to adjust a duty cycle and frequency of said series of drive pulses which regulate said output voltage;

an over-voltage protection circuit coupled to said converter and said feedback line, said over-voltage protection circuit detects when said output voltage exceeds said second threshold voltage and transmits a control signal; and an over-voltage protection latch circuit coupled to said over-voltage protection circuit and said converter, said over-voltage protection latch circuit deactivates said switching transistor of said converter and maintains said switching transistor in a deactive state upon receiving said control signal from said over-voltage protection circuit.

19. The system according to claim 18, wherein said pre-drive circuit further includes a hysteresis network coupled to said first input of said comparator and an output of said comparator.

20. The system according to claim 19, wherein said comparator of said pre-drive circuit outputs an oscillatory pre-drive signal to said drive circuit which sets the duty cycle and frequency of said series of drive pulses, said oscillating pre-drive signal causes one of the series of drive pulses to deactivate the switching transistor when a sense voltage, which is based on said output voltage and said hysteresis voltage and applied to said first input of said comparator, exceeds a reference voltage applied to a second input of said comparator.

21. The system according to claim 19, wherein the pre-drive circuit further comprises a resistor network coupled to said first input of said comparator, said resistor network is programmable to adjust said sense voltage in order to produce said output voltage ranging from a minimum threshold voltage to a maximum threshold voltage.

22. The system according to claim 21, wherein said resistor network includes a fixed resistor and a plurality of programmable resistors configured in parallel with said fixed resistor, said resistor network receives a binary voltage identification to select one or more of said plurality of programmable resistors in order to alter said output voltage as desired.

23. An electronic system comprising:

voltage reference means for providing a reference voltage;

converter means for receiving said reference voltage and providing an output voltage having a ripple oscillating voltage between a first and second threshold voltage, said converter means is coupled to said voltage reference means and includes switching means for supplying an input voltage to an output stage means when said switching means is activated, said output stage means for producing said output voltage from said input voltage along a feedback line, said output means being coupled to said switching means, drive means for adjusting said output voltage by generating a series of drive pulses to activate and deactivate said switching means, said drive means being coupled to said switching means, and pre-drive means for utilizing hysteresis voltage in order to adjust a duty cycle and frequency of said series of drive pulses, said pre-drive means, being coupled to said drive means and said feedback line, includes a comparator means for comparing said reference voltage with a sense voltage including said hysteresis voltage;

over-voltage protection means for detecting when said output voltage exceeds said second threshold voltage and transmits a control signal to deactivate said switching means, said over voltage protection means being coupled to said converter means; and over-voltage protection latch means for deactivating said switching means and maintains said switching means in a deactive state upon receiving said control signal from said over-voltage protection means, said over-voltage protection latch means is coupled to said over voltage protection means and said converter means.

24. The system according to claim 23, wherein said pre-drive means further includes a hysteresis network coupled to a first input of said comparator means and an output of said comparator means.

25. The system according to claim 24, wherein the pre-drive means further comprises a resistor network coupled to said first input of said comparator means, said resistor network is programmable to adjust said sense voltage in order to produce said output voltage ranging from a first threshold voltage to a second threshold voltage.

26. The system according to claim 25, wherein said resistor network includes a fixed resistor and a plurality of programmable resistors configured in parallel with said fixed resistor, said resistor network receives a binary voltage identification to select one or more of said plurality of programmable resistors in order to alter said ripple voltage as desired.

27. A method for regulating an output voltage of a switching regulator circuit comprising the steps of:

generating the output voltage in response to a power switching transistor being switched on and off;

generating a hysteresis voltage in response to the output voltage;

generating a sense voltage in response to the output voltage and said hysteresis voltage;

comparing the sense voltage to a reference voltage;

producing a pre-drive signal which adjusts the output voltage by varying a duty cycle and frequency of a series of drive pulses which activate and deactivate the power switching transistor, the output voltage oscillating between a minimum threshold voltage and a maximum threshold voltage.

* * * * *